US005749823A

United States Patent [19]

Richards

[11] Patent Number: 5,749,823

[45] Date of Patent: May 12, 1998

[54] SIGNATURE CONTROL IN A HIGH SPEED PRINTING PRESS

[75] Inventor: John Richards, Barrington, N.H.

[73] Assignees: Heidelberger Druckmaschinen AG, Heidelberg, Germany; Heidelberg Harris, Inc., Dover, N.H.

[21] Appl. No.: 412,038

[22] Filed: Mar. 28, 1995

[51] Int. Cl.[6] ..... B31B 1/04

[52] U.S. Cl. ..... 493/417; 493/23

[58] Field of Search ..... 493/8, 9, 10, 13, 493/14, 15, 17, 18, 19, 20, 23, 25, 34, 405, 417, 254, 437

[56] References Cited

U.S. PATENT DOCUMENTS

| | | | |
|---|---|---|---|
| 3,176,977 | 4/1965 | Graf et al. | 493/14 |
| 3,228,680 | 1/1966 | Fowler | 271/51 |
| 3,809,387 | 5/1974 | Heist | 270/79 |
| 3,908,980 | 9/1975 | Fowler | 271/3 |
| 4,573,671 | 3/1986 | Reponty | 270/20.1 |
| 4,946,012 | 8/1990 | Foster | 192/1.46 |
| 4,995,858 | 2/1991 | Stab | 493/445 |
| 5,120,290 | 6/1992 | Bay | 493/14 |
| 5,158,524 | 10/1992 | Muto | 493/417 |

FOREIGN PATENT DOCUMENTS 5-309828 11/1993 Japan .

*Primary Examiner*—Joseph J. Hail, III
*Assistant Examiner*—Christopher W. Day
*Attorney, Agent, or Firm*—Kenyon & Kenyon

[57] ABSTRACT

A controllable actuator for stopping and positioning a signature in a high speed printing press including a electric magnet or a solenoid and a break or a roller or both. Various arrangements of a plurality of such actuators can be used to orient, center, and steer signatures in a high speed printing press.

18 Claims, 9 Drawing Sheets

SIGNATURE CONTROL IN A HIGH SPEED PRINTING PRESS

BACKGROUND OF THE INVENTION

The present invention relates to signature control, such as stopping and positioning a signature, in high speed printing presses. A signature is a large sheet with two or more pages, that may become a section of a book. Before receiving its final fold, a signature is positioned on a flat surface over a slot in the surface. The signature is then pushed through the slot in the surface by a folding blade thereby folding the signature in half. This is termed "quarter-folding," since the signature may have previously been folded in half, or "half-folded."

If the signature is not properly positioned over the slot, it will be improperly folded. For example, if the signature is not squarely positioned over the slot, the fold will not be parallel to the edges of the signature. If the exact middle of the signature is not positioned over the slot, one page of the folded signature will be larger than the other. Accordingly, devices are needed to properly position the signature relative to the slot and relative to the folding blade.

In the past, signatures were stopped by one or more of the following devices. A head stop is a physical protrusion on a flat surface (e.g., a table) and has a straight surface defining a desired alignment for the signature. When a signature strikes this straight surface, it will become aligned with it. Unfortunately, if the velocity of the signature is too great when it strikes the head stop, the paper may bend or buckle. Brushes arranged above the table surface can be used to decelerate the signature. Accordingly, brushes are often used in conjunction with head stops and precede the head stop such that the signature is decelerated before contacting the head stop. Moreover, drive belts, which may be equipped with tensioners, and which are arranged above and/or below the signature can control the positioning of the signature.

While these known devices can be adjusted to position signatures for average (i.e., ambient) conditions, they cannot be adjusted on a signature-to-signature basis. That is, while the known devices can be adjusted before a series (i.e., a run) of signatures, they cannot be adjusted "on-the-fly" based on characteristics of each individual signature. Accordingly, devices for rapidly positioning and stopping signatures in high speed printing presses are needed. Moreover, these devices should be adjustable on a signature-to-signature basis.

An arrangement for rapidly positioning and stopping signatures in a high speed press should include: high speed sensors for detecting characteristics of each signature to be positioned; actuators for positioning and stopping the detected signature; and controllers for controlling the actuators based on the characteristics of the signature detected by the sensors. The controller should be able to determine signature position, orientation, linear velocity and acceleration. The controller may also be used to determine angular velocity and acceleration.

Adequate high speed sensors and controllers are available. For example, photo-electric, piezo-electric, and laser sensors are available for detecting signatures. The position, orientation, velocity and acceleration of the signature can be calculated based on signals from an arrangement of these sensors. Moreover, microprocessors, for example, are available for controlling actuators based on input signals supplied by sensors.

Since adequate sensors and controllers are available, the critical area for rapidly detecting and stopping signatures while considering variations in the characteristics of each individual signature is actuator design. Accordingly, the object of the present invention is to provide controllable actuators for positioning and stopping signatures. A further object of the present invention is to provide controllable actuators which can be quickly actuated based on characteristics of each individual signature.

SUMMARY OF THE INVENTION

The present invention attains the above mentioned objects by providing an actuator having a magnetic core, a coil, a pivoting arm, and a positioner. The magnetic core is arranged below a table surface and preferably has an end surface substantially coplanar with the table surface. The coil is arranged radially outside the magnetic core. The pivoting arm is arranged above the table surface and is preferably biased away from the table. The positioner is coupled with the pivoting arm. When a current is provided through the coil, the magnetic core attracts the positioner.

The positioner may be a rider plate or a roller. In a preferred embodiment of the present invention, when a roller is employed as the positioner, the magnetic core is also formed as a roller. The actuator of the present invention may be used in an arrangement having at least one sensor for detecting a signature, and a controller. The controller has at least one input accepting a signal from the at least one sensor, and has at least one output providing a control signal to the actuator.

The actuator of the present invention may be included in an arrangement for squaring a misoriented signature on a table relative to a folding slot. First and second actuators are arranged in a line perpendicular to the slot in the table, the first actuator being arranged between a left edge and the centerline of the signature and the second actuator being arranged between a right edge and the centerline of the signature. When a leading right edge of the signature precedes a leading left edge of the signature, the second actuator is actuated before the first actuator and when a leading left edge of the signature precedes a leading right edge of the signature, the first actuator is actuated before the second actuator.

The actuators of the present invention may also be included in an arrangement for centering a signature on a table relative to a folding slot. A first actuator is arranged on a first edge side of the slot and second actuator is arranged on a second edge side of the slot. When the first and second actuators are activated and the centerline of the signature is located between the slot and the first edge, the first actuator is released before the second actuator. When the first and second actuators are activated and the centerline of the signature is located between the slot and the second edge, the second actuator is released before the first actuator.

In an alternative embodiment, the actuator may include a housing, a signature contact, and a solenoid. The housing has a top end and a bottom end, and is pivotable about a pivot point. The signature contact is held by the housing and projects out from the bottom end of the housing. The solenoid is mechanically coupled to the housing and has a first state and a second state. When the solenoid is in the first state, the signature contact does not contact the signature. When the solenoid is in the second state, the signature contact is put into contact with the signature. The signature contact may be either a rider plate or a roller. The roller may be an idle roller.

BRIEF DESCRIPTION OF THE DRAWINGS

FIG. 12 shows a side view illustrating an actuator according to an alternate embodiment of the present invention.

DETAILED DESCRIPTION OF THE INVENTION

Figure 1:
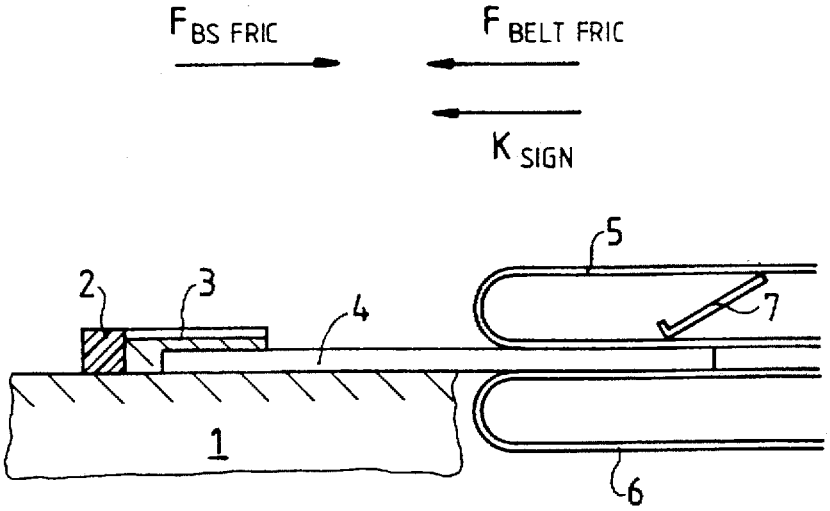
Fig. 1 (PRIOR ART)
FIG. 1 is a cross-sectional side view of known devices for stopping and positioning a signature.

The prior art devices for stopping signatures, mentioned in the BACKGROUND, are illustrated in FIG. 1. The signature 4 is stopped and positioned on a flat surface, such as a table 1, by a head stop 2. The signature is decelerated by friction between it and a brush 3. Upper and lower feed belts 5 and 6, respectively, can also control the movement of the signature 4 when tensioners 7 force the belts against the signature 4. The signature 4 has a kinetic energy $K_{SIG}$ which is dissipated by the force of friction between the brush 3 and the signature 4 $F_{BSFRIC}$. The force of friction between the brush 3 and the signature 4 $F_{BSFRIC}$ is greater than, and directed opposite to, the force of friction between the belts and the signature 4 $F_{BELTFRIC}$. The force and kinetic energy vectors are illustrated in FIG. 1.

Figure 2A:
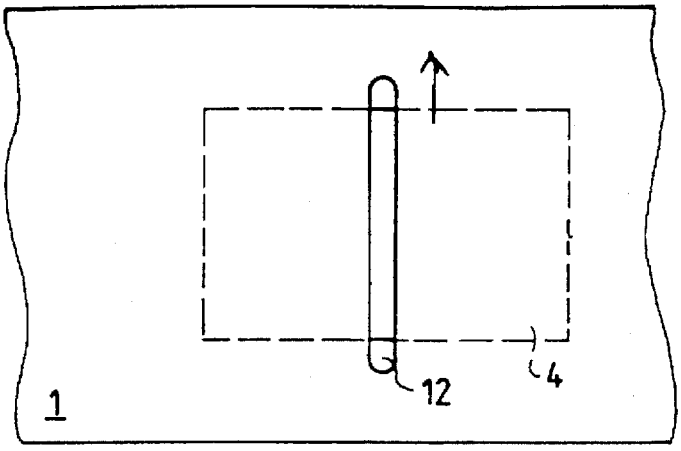
FIG. 2*a* is a plan view.
Figure 2B:
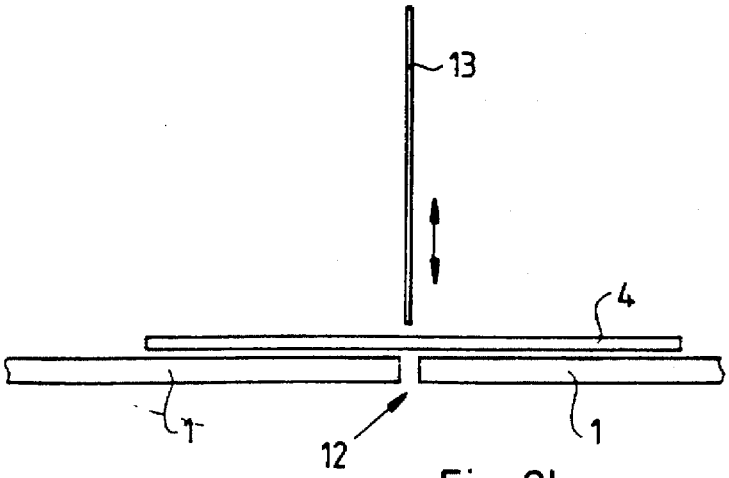
FIGS. 2*b* through 2*e* are side views, illustrating the folding of a signature.
Figure 2C:
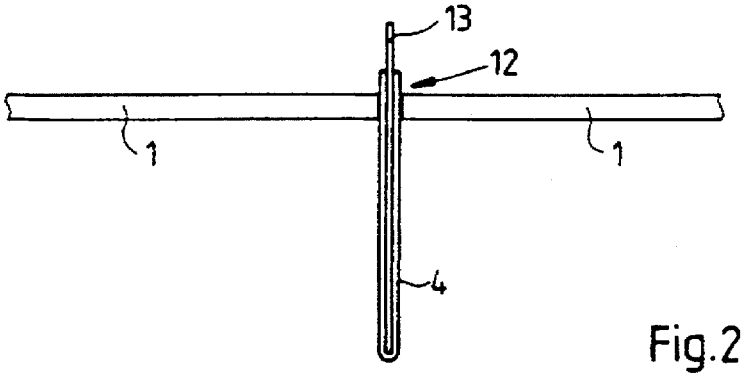
Figure 2D:
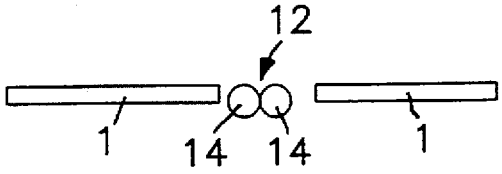
Figure 2E:
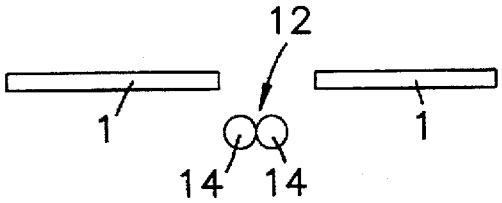
Figure 8:
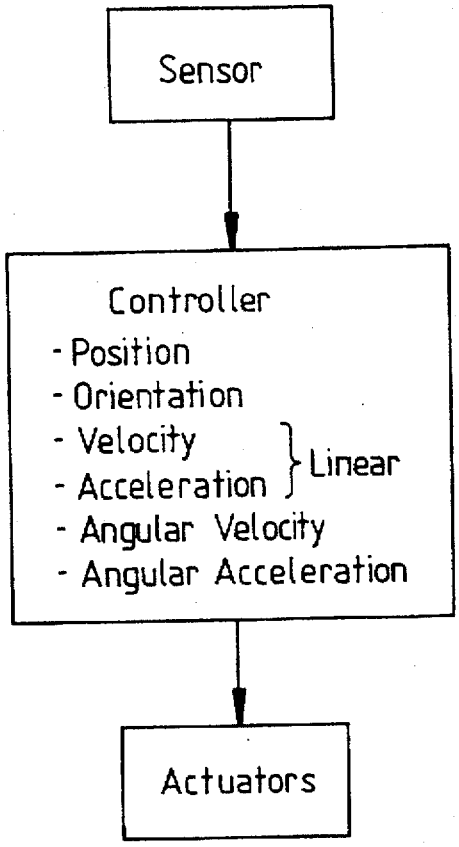
FIG. 8 is a block diagram of a control system using the actuators of the present invention.

Devices for folding a signature 4 are illustrated in FIGS. 2*a* through 2*c*. The signature 4 is positioned on a flat surface, such as a table 1, by actuators (not shown, to be described in more detail below) so that the signature 4 is squarely centered over slot 12 as shown in the plan view of FIG. 2*a*. The actuators are controlled by a controller which is provided with inputs from sensors. FIG. 8 is a functional diagram showing the relationship between the sensors, the controller, and the actuators. As shown in the cross-sectional side view of FIG. 2*b*, a folder blade 13 is located above the signature such that the slot 12 lies in a plane defined by the folder blade. The folder blade 13 can be actuated up and down as shown by the arrows in FIG. 2*b*. FIG. 2*c* illustrates the folding of the signature 4 by the folder blade 13. Specifically, the folder blade 13 contacts the signature 4 at its centerline and pushes it through the slot 12 in the table 1. FIGS. 2*d* and 2*e* are partial side views which illustrate alternative slots 12 employing folding rollers 14 and 14', respectively.

Figure 3:
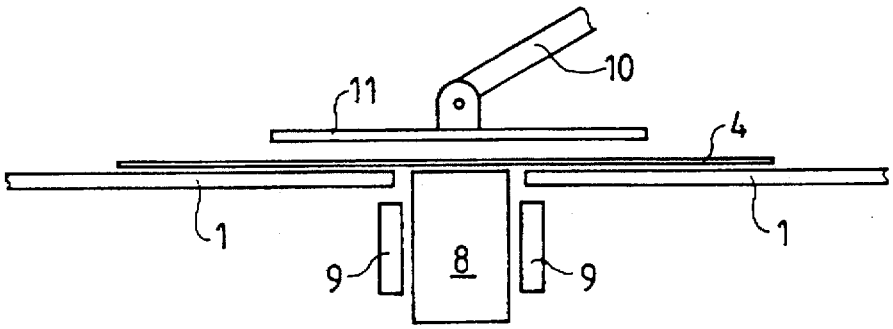
FIG. 3 is a side view illustrating an actuator according to the present invention.

As mentioned above in the Summary of Invention, the present invention provides high speed means for braking and steering the signature 4. Specifically, variable magnetic actuators are used to actuate brakes or rollers or both. A variable magnetic actuator for actuating a brake is illustrated in FIG. 3. As shown in FIG. 3, the signature 4 is positioned on a table 1 between a magnetic core 8 and a rider plate 11. The magnetic core 8 has a top surface which is substantially flush (i.e., coplanar) with the top surface of the table 1. A pivot arm 10 holding the rider plate 11 is normally biased upward. However, when the magnetic core 8 is energized by a current flowing through coils 9, the rider plate 11 is drawn towards the magnetic core 8 thereby braking the signature 4. Solenoid actuated wheels and plates can also be used to decelerated or stop signatures 4. A few exemplary arrangements of brakes used to square and to center signatures are described below.

Figure 4A:
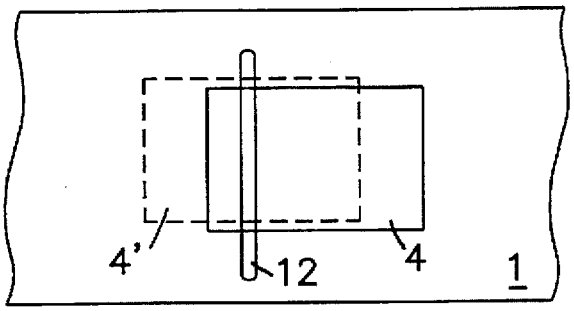
FIGS. 4*a* and 4*b* are plan views illustrating centering errors of signatures and orientation error of signatures, respectively.
Figure 4B:
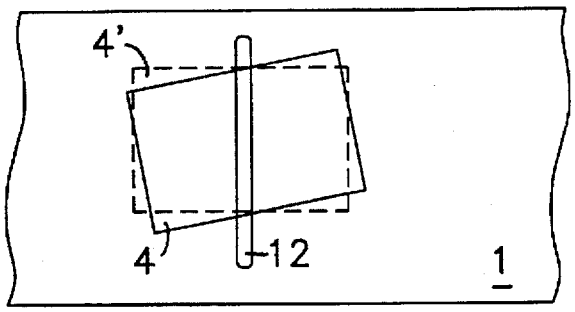

FIG. 4*a* is a plan view which illustrates a signature 4 which is not centered with respect to the slot 12. The desired orientation of the signature 4' is shown in phantom. Correcting the signature 4 when it is not properly centered is described below with reference to FIGS. 7*a* through 7*c*. FIG. 4*b* is a plan view which illustrates a signature 4 which is not square with respect to the slot 12. The desired orientation of the signature 4' is shown in phantom. Correcting the orientation of the signature 4 when it is determined that it will not otherwise be properly squared is described below with reference to FIGS. 5*a* and 5*b*.

Figure 7A:
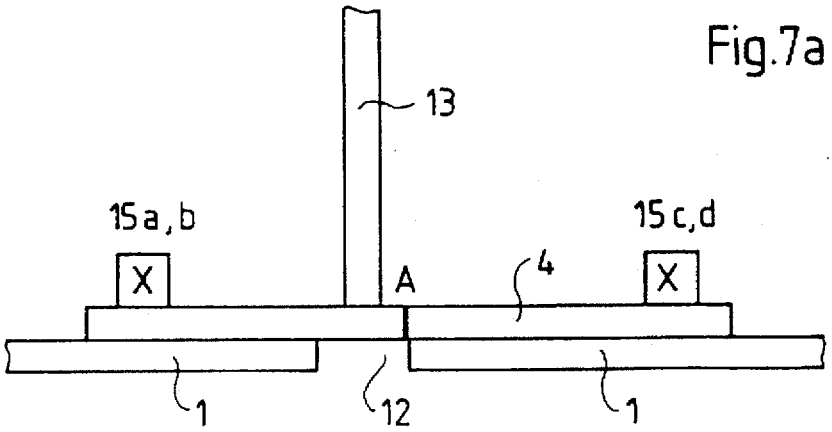
FIGS. 7*a* through 7*c* are cross-sectional side views illustrating the use of the actuators of the present invention to center a signature.
Figure 7B:
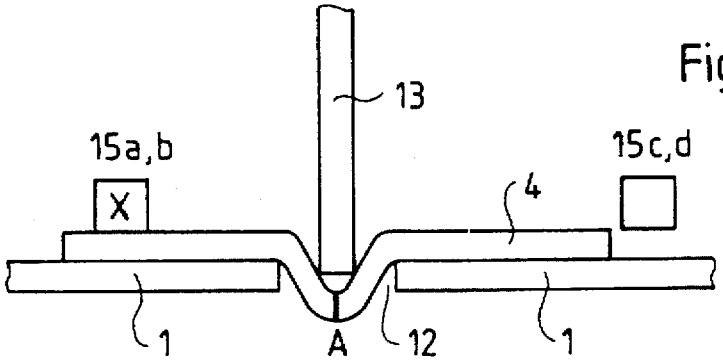
Figure 7C:
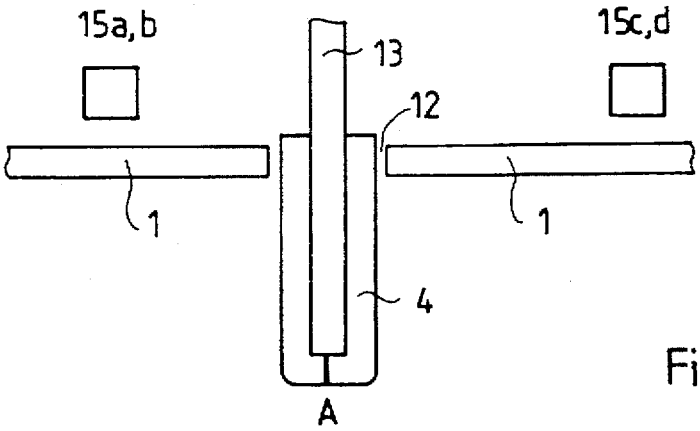

An example of centering the signature 4 so that it is folded along its center line is illustrated in the cross-sectional side views of FIGS. 7*a* through 7*c*. As FIG. 7*a* illustrates, the signature 4 is stopped on the table 1 over the slot 12 by brakes 15*a* through 15*d* (note brake 15*b* is located behind brake 15*a* and brake 15*d* is located behind brake 15*c*). Actuated brakes are indicated by an "X". In this example, it is assumed that the signature is squared. However, the centerline, A, is located to the right of the center of the slot 12. Accordingly, when the folder blade 13 is deployed, the brakes 15*c* and 15*d* on the longer side of the signature 4 are released before the brakes 15*a* and 15*b* on the shorter side of the signature 4 are released as shown in FIG. 7*b*. When the centerline, A, of the signature 4 is located at the center of the slot 12, i.e., just beneath the folder blade 13 (as calculated by the controller based on information from the sensors), the brakes 15*a* and 15*b* are released and the signature 4 is folded as shown in FIGS. 7*b* and 7*c*.

Figure 5A:
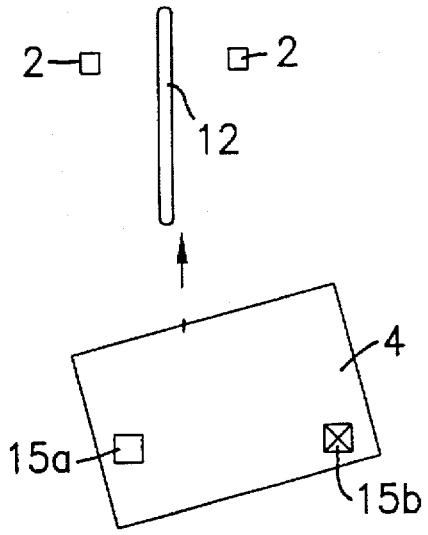
FIGS. 5*a* and 5*b* are plan views illustrating an arrangement of actuators, according to the present invention, for correcting the orientation of a misoriented signature.
Figure 5B:
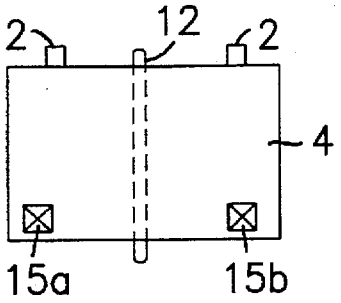

An example of squaring a signature 4 is illustrated in the plan views of FIGS. 5*a* and 5*b*. The signature 4 shown in FIG. 5*a* is moving from bottom to top as indicated by the arrow. When sensors (not shown) detect that the top leading corner $4_{TOP,\ LEADING}$ of the signature 4 lags the bottom leading corner $4_{BOTTOM,\ LEADING}$ of the signature 4, the bottom brake 15*b* is activated at the trailing side of the signature 4 thereby creating a pivot point. At the instant when the paper is square (as calculated by the controller based on information from the sensors), the top brake 15*a* is also activated so that the signature 4 is squarely positioned. Head stops 2 may be used with the brakes 15*a*. The brakes are activated in the opposite sequence when the top leading corner $4_{TOP,\ LEADING}$ of the signature 4 leads the bottom leading corner $4_{BOTTOM,\ LEADING}$ of the signature 4.

As shown in FIG. 12, rollers 16 can be used as an alternative to the rider plate 11 or brakes 15, i.e., the rider plate 11 of FIG. 3 can be replaced with a roller 16. In a refinement of this alternative embodiment, the electromagnet 8,9 can also be formed as a roller. Such a refinement would assure that the signature 4 would follow a direction perpendicular to the axis of the roller 16 and not stick to the electromagnet or follow some intermediate course.

Figure 6:
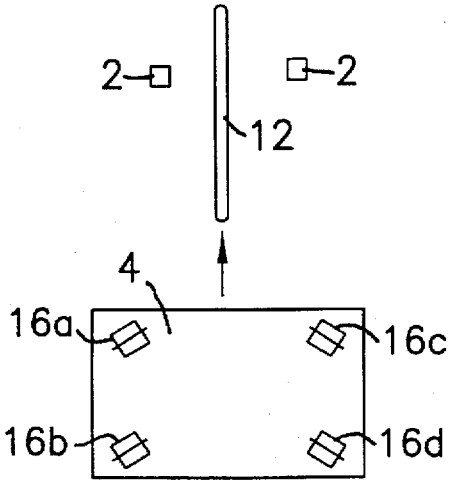
FIG. 6 is a plan view which illustrates an alternative embodiment of the actuators of the present invention.

As shown in FIG. 6, two pairs of roller mechanisms 16*a* through 16*d* are arranged in a rectangle. The signature 4 moves from bottom to top as is indicated by the arrow. The axes of rollers 16*a* and 16*b* are skewed at a positive angle with respect to the direction of motion of the signature 4. The axes of rollers 16*c* and 16*d* are skewed at a negative angle with respect to the direction of the motion of the signature. If rollers 16*a* and 16*b* are deployed while rollers 16*c* and 16*d* are not, the signature 4 is steered to the left. On the other hand, if rollers 16*c* and 16*d* are deployed while rollers 16*a* and 16*b* are not, the signature is steered to the right.

In a further refinement of this alternative embodiment, sensors can be used to sense the rotation of the roller.

Figure 9:
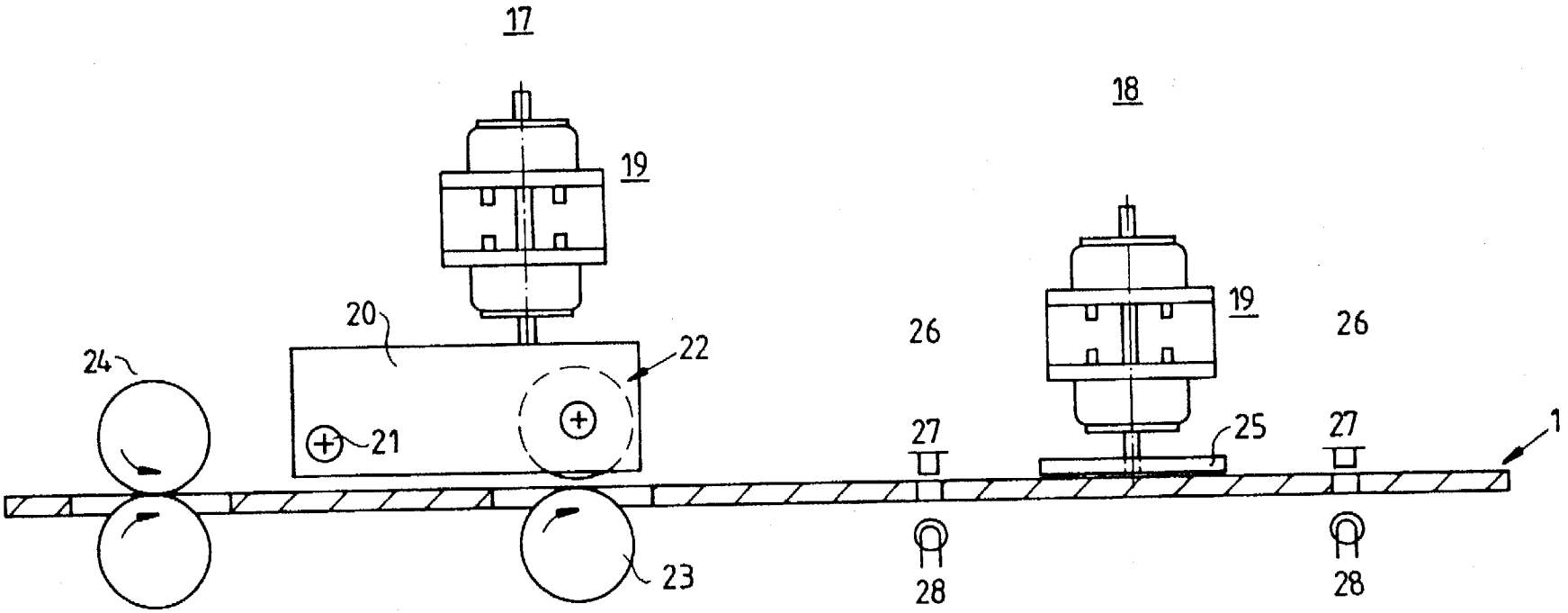
FIG. 9 is a side view of a solenoid actuated slow down brake and of a solenoid actuated stopping brake.

In a further alternative embodiment, solenoid actuated deceleration and stopping brakes are used. FIG. 9 illustrates a side view of a deceleration brake 17 followed by a stopping brake 18.

The deceleration brake 17 includes a solenoid 19 mechanically coupled to an idle roller assembly 20. The solenoid 19 is controlled by a controller (not shown). The idle roller assembly 20 is pivotable about a pivot point 21 and includes an idle (i.e., not powered) roller 22. Signature drive rollers 24 are arranged before the deceleration brake 17 and propel the signature 4 at a fast speed, for example at 255 inches/sec. The roller 23 is driven at a slower angular velocity such that the signature 4 is slowed, for example, to about 90 inches/sec. When the solenoid 19 is actuated, the idle roller assembly 20 pivots clockwise about its pivot point 21 such that a signature 4 is sandwiched between idle roller 22 and roller 23. Thus, the signature 4 is decelerated.

The stopping brake 18 also includes a solenoid 19 which is mechanically coupled with a brake pad 25. The solenoid 19 is actuated by a controller (not shown). When the solenoid is actuated, a signature 4 between the brake pad 25 and the table surface 1 is stopped.

FIG. 9 also illustrates an example of sensors 26 that may be used with the present invention. The sensors 26 include a light emitting element 28 (such as a light emitting diode) and a photodetector 27.

Figure 10B:
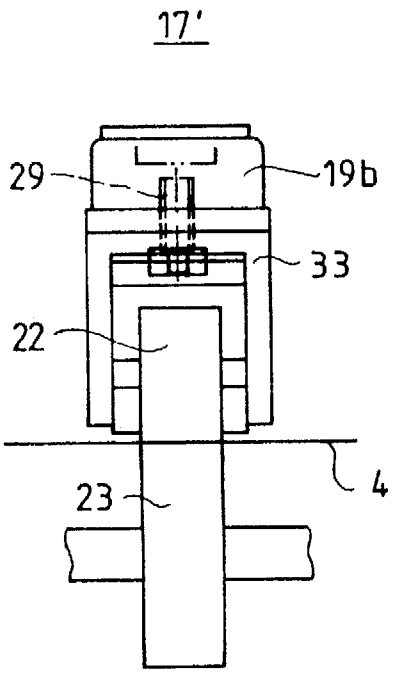
FIG. 10*b* is an end view, of a solenoid actuated slow down brake.
Figure 10A:
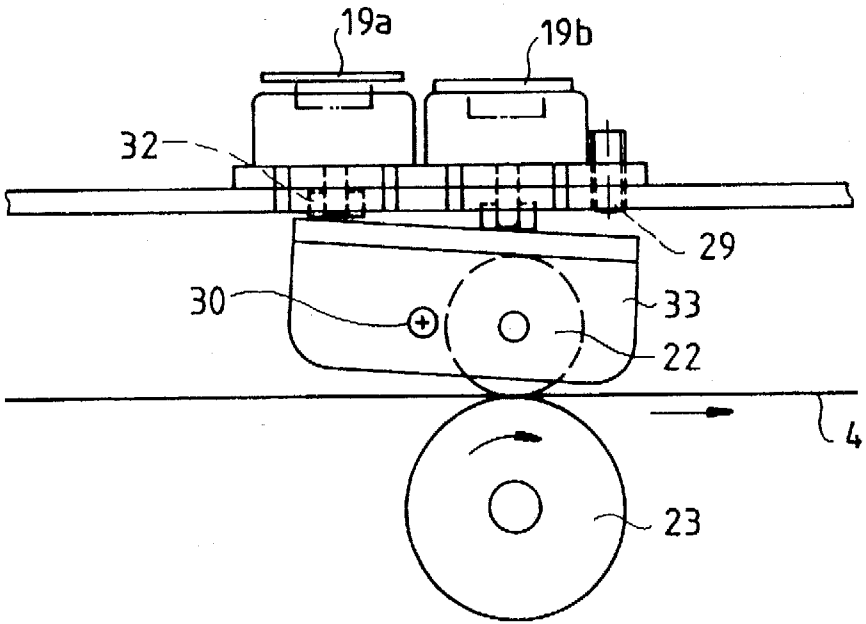
FIG. 10*a* is a side view.

FIGS. 10*a* and 10*b* are a side view and an end view, respectively, of a refined embodiment of a deceleration roller 17' of the present invention. An idle roller 22 is held in a housing 33. The housing 33 is pivotable about pivot 30. A release solenoid 19*a* is arranged above the housing 33 on a side of the pivot 30 opposite to the idle roller 22. A deceleration solenoid 19*b* is arranged above the housing 33 on the same side of the pivot 30 as the idle roller 22.

The solenoids 19*a* and 19*b* are provided with input signals from a controller (not shown). Each of the solenoids includes an adjustable collar 32 which permits the stroke of the solenoid to be adjusted. The solenoids 19*a* and 19*b* are controlled such that they cannot be activated simultaneously.

When solenoid 19*a* is activated, the housing 33 pivots counterclockwise about the pivot 30 so that the idle roller 22 is cleared from the signature 4 by a clearance determined by an adjustable clearance screw 29. When solenoid 19*b* is activated, the housing 33 pivots clockwise about the pivot 30 so that the idle roller 22 contacts the signature 4, thereby sandwiching the signature 4 between it and the roller 23.

Figure 11B:
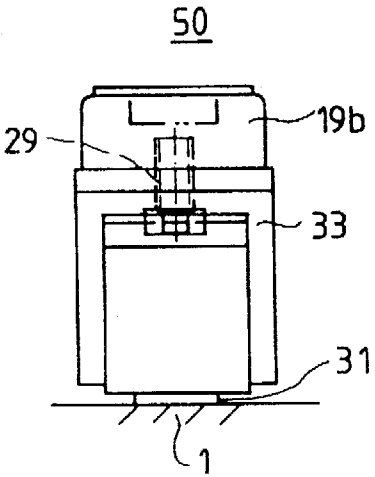
FIG. 11*b* is an end view of a solenoid actuated stopping brake.
Figure 11A:
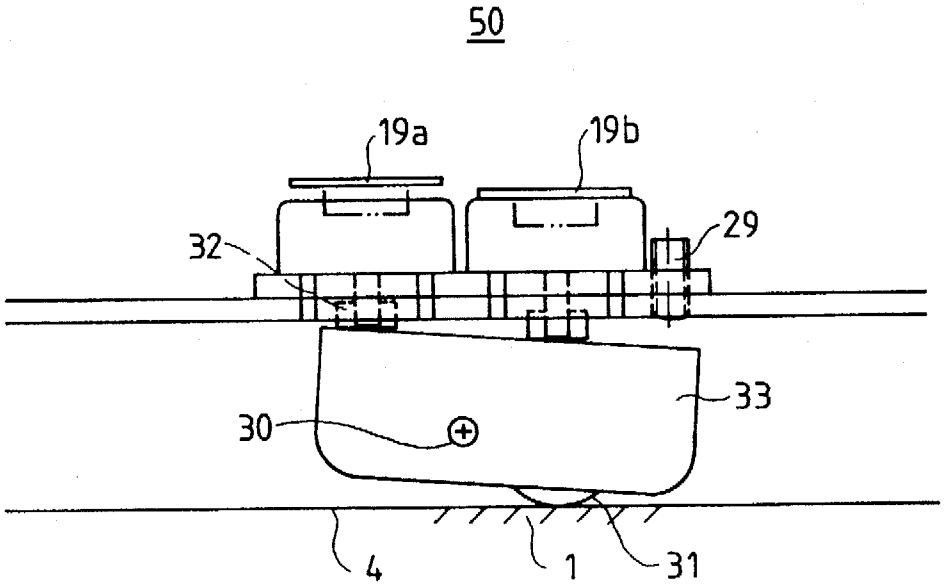
FIG. 11*a* is a side view.

FIGS. 11*a* and 11*b* are a side view and an end view, respectively, of a refined embodiment of the brake 50 of the present invention. A brake shoe 31 is held by a brake housing 33. The brake housing 33 is pivotable about pivot 30. A release solenoid 19*a* is arranged above the brake housing 33 on a side of the pivot 30 opposite the brake shoe 31. A braking solenoid 19*b* is arranged above the brake housing 33, on the same side of the pivot 30 as the brake shoe 31.

The solenoids 19*a* and 19*b* are provided with input signals from a controller (not shown). Each of the solenoids includes an adjustable collar 32 which permits the stroke of the solenoid to be adjusted. The solenoids 19*a* and 19*b* are controlled such that they cannot be activated simultaneously.

When solenoid 19*a* is activated, the brake housing 33 pivots counterclockwise about the pivot 30 so that the brake shoe 31 is cleared from the signature 4 by a clearance determined by an adjustable clearance screw 29. When solenoid 19*b* is activated, the brake housing 33 pivots clockwise about the pivot 30 so that the brake shoe 31 contacts the signature 4, thereby holding the signature 4 between it and the table surface 1.

Both the magnetically actuated brakes and rollers are located slightly above the signature thereby minimizing the mechanical travel of the brakes and rollers, and ensuring quick actuation. Before a run of signatures of a particular stock and thickness is initiated, the starting and stopping static and dynamic frictions suitable for the particular type of signatures can be determined during a "make-ready" mode in which a closed loop feedback system is used to iteratively determine these values. If the rollers are equipped with rotational sensors, a comparison of the setpoint roller motion with the actual roller motion can be used to adjust the electromagnetic force to properly stop and position the signature.

In each of the above examples, known sensors provide inputs to a controller, such as a microprocessor or programmable controller, which may calculate position, orientation, linear velocity and acceleration, and angular velocity and acceleration of the signature 4. The actuators, whether brakes 15 or rollers 16, are actuated based on control signals from the controller.

The above examples illustrate just some of the arrangements of the actuators of the present invention and are not intended to limit the scope of the invention as defined by the claims.

What is claimed is:

1. An apparatus for positioning a signature on a table surface, the apparatus comprising:

a first actuator including a first magnetic core arranged adjacent to the table surface;

a first coil arranged radially outside the first magnetic core;

a first pivoting arm arranged adjacent to the table surface and opposite of the first magnetic core; and a first positioner, at least a portion of which is formed of ferromagnetic material, coupled with the first pivoting arm;

a second actuator including a second magnetic core arranged adjacent to the table surface;

a second coil arranged radially outside the second magnetic core;

a second pivoting arm arranged adjacent to the table surface and opposite of the second magnetic core; and a second positioner, at least a portion of which is formed of ferromagnetic material, coupled with the second pivoting arm;

a sensor for sensing the position of a signature moving on the table;

a controller coupled to the sensor and to the first and second coils for providing a current to the first and second coils, wherein, when a current is provided through the first coil, the first magnetic core attracts the first positioner toward the table surface so that the first positioner contacts a first portion of the signature to retard motion of the first portion of the signature across the table surface and wherein when a current is provided through the second coil, the second magnetic core attracts the second positioner toward the table surface so that the second positioner contacts a second portion of the signature to retard motion of the second portion of the signature across the table surface to control the signature's path of movement on the table.

2. The apparatus of claim 1 wherein the first positioner is a rider plate.

3. The apparatus of claim 2 wherein the first magnetic core has an end surface substantially coplanar with the table surface.

4. The apparatus of claim 2 wherein the first pivoting arm is biased away from the table surface.

5. The apparatus of claim 1 wherein the first positioner is a roller.

6. The apparatus of claim 5 wherein the first magnetic core has an end surface substantially coplanar with the table surface.

7. The apparatus of claim 6 wherein the roller has a defined first axis of rotation and wherein the first magnetic core is a second roller having a second axis of rotation parallel to the first axis of rotation.

8. The apparatus of claim 5 wherein said pivoting arm is biased away from the table surface.

9. An arrangement for squaring a signature moving toward a desired position on a table relative to a folding slot, the signature including a leading edge, a trailing edge and a centerline centered between the left edge and the right edge, the arrangement comprising:

a) a first actuator including i) a first magnetic core arranged adjacent to the table surface;

ii) a first coil arranged radially outside said first magnetic core;

iii) a first pivoting arm arranged adjacent to the table surface and opposite of the first magnetic core; and iv) a first positioner, at least a portion of which is formed of ferromagnetic material, coupled with said first pivoting arm, wherein, when a current is provided through said first coil, the first magnetic core attracts said first positioner; and b) a second actuator including i) a second magnetic core arranged adjacent to the table surface;

ii) a second coil arranged radially outside said second magnetic core;

iii) a second pivoting arm arranged adjacent to the table surface and opposite of the second magnetic core; and iv) a second positioner, at least a portion of which is formed of ferromagnetic material, coupled with said second pivoting arm, wherein, when a current is provided through said second coil, the second magnetic core attracts said second positioner, wherein said first and second actuators are arranged in a line perpendicular to the slot in the table, wherein said first actuator is arranged between a left edge and a centerline of the desired position of the signature and said second actuator is arranged between a right edge and a centerline of the desired position of the signature, and wherein when a leading left edge of the signature precedes a leading right edge of the signature, the first actuator is actuated before the second actuator to retard movement of the left leading edge of the signature toward the desired position and when a leading right edge of the signature precedes a leading left edge of the signature, the second actuator is actuated before the first actuator to retard movement of the right leading edge of the signature toward the desired position.

10. The arrangement of claim 9 wherein the first and second positioners are rider plates.

11. The arrangement of claim 9 wherein the first and second positioners are rollers.

12. An arrangement for centering a signature on a table relative to a folding slot, the signature including a left edge, a right edge, and a centerline centered between the left edge and the right edge, the arrangement comprising:

a) a first actuator including i) a first magnetic core arranged adjacent to the table surface;

ii) a first coil arranged radially outside said first magnetic core;

iii) a first pivoting arm arranged adjacent to the table surface and opposite of the first magnetic core; and iv) a first positioner, at least a portion of which is formed of ferromagnetic material, coupled with said first pivoting arm, wherein, when a current is provided through said first coil, the first magnetic core attracts said first positioner; and b) a second actuator including i) a second magnetic core arranged adjacent to the table surface;

ii) a second coil arranged radially outside said second magnetic core;

iii) a second pivoting arm arranged adjacent to the table surface and opposite of the second magnetic core; and iv) a second positioner, at least a portion of which is formed of ferromagnetic material, coupled with said second pivoting arm, wherein, when a current is provided through said second coil, the second magnetic core attracts said second positioner; and a folding device for moving the signature into the folding slot, wherein said first actuator is arranged on a left edge side of the slot and said second actuator is arranged on a right edge side of the slot, wherein when said first and second actuators are actuated and said centerline of said signature is located between the slot and the left edge as the folding device moves the signature into the folding slot, the first actuator is released before the second actuator so that said left edge is drawn toward the slot, and wherein when said first and second actuators are actuated and said centerline of said signature is located between the slot and the right edge as the folding device moves the signature into the folding slot, the second actuator is released before the first actuator so that said right edge is drawn toward the slot.

13. The arrangement of claim 12 wherein the first and second positioners are rider plates.

14. The arrangement of claim 13 wherein the first and second positioners are rollers.

15. An actuator for positioning a signature on a table surface, the actuator comprising:

a) a housing having a top end and a bottom end, and being pivotable about a pivot point;

b) a signature contact being held by said housing and projecting out from said bottom end of said housing;

c) a solenoid being mechanically coupled to said housing and having a first state and a second state, wherein, when said solenoid is in said first state, the signature contact does not contact the signature and when said solenoid is in said second state, the signature contact is put into contact with the signature.

16. The actuator of claim 15 wherein said signature contact is a rider plate.

17. The actuator of claim 16 wherein said signature contact is a roller.

18. The actuator of claim 17 wherein said roller is an idle roller.

* * * * *